US007137822B1

(12) United States Patent
Longmire et al.

(10) Patent No.: US 7,137,822 B1
(45) Date of Patent: Nov. 21, 2006

(54) HIGH VOLTAGE SWIVEL

(75) Inventors: Stuart Longmire, Menton (FR); René Perratone, Menton (FR); Jack Pollack, Houston, TX (US)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 11/312,431

(22) Filed: Dec. 21, 2005

(51) Int. Cl.
*H01R 39/00* (2006.01)

(52) U.S. Cl. ..... 439/24

(58) Field of Classification Search ..... 439/24–26, 439/21–23, 6, 165, 191–194, 395, 668–669, 439/201; 248/917, 921, 923
See application file for complete search history.

(56) References Cited

U.S. PATENT DOCUMENTS 6,398,590 B1 * 6/2002 Banas et al. ..... 439/668
6,561,813 B1 * 5/2003 Rutten et al. ..... 439/26
6,830,456 B1 * 12/2004 Obermeyer ..... 439/6
6,908,310 B1 * 6/2005 Olsson et al. ..... 439/26

* cited by examiner

*Primary Examiner*—J. F. Duverne
(74) *Attorney, Agent, or Firm*—Young & Thompson

(57) ABSTRACT

A high voltage swivel, includes an annular outer element defining a cylindrical chamber around a longitudinal axis and an inner cylindrical element coaxial with the outer element and rotatable relative thereto around the axis. The inner and outer elements each include at least two axially spaced conductors rotatable with the inner and outer elements, the conductors forming at least two pairs placed with contact surfaces in mutual electrical contact. One conductor in each pair is provided at the inner element, the other at the outer element and being connected to a respective voltage line which extends to an input terminal and to an output terminal respectively, the conductors being surrounded by an insulating material. The conductors of the outer element are provided in a recess in an annular solid outer insulating ring, the conductors of the inner element are provided in a recess in an annular solid inner insulating ring.

14 Claims, 4 Drawing Sheets

HIGH VOLTAGE SWIVEL

The invention relates to a high voltage swivel, comprising an annular outer element defining a cylindrical chamber around a longitudinal axis and an inner cylindrical element coaxial with the outer element and rotatable relative to said outer element around said longitudinal axis, the inner and outer elements each comprising two axially spaced electrical conductors which conductors are rotatable with the inner and outer elements, the conductors forming two pairs placed with contact surfaces in mutual electrical contact, one conductor in each pair being provided at the inner element, the other at the outer element and being connected to a respective voltage line which extends to an input terminal and to an output terminal respectively, the conductors being surrounded by an insulating material.

Such a swivel is known from U.S. Pat. No. 4,252,388 describing a slip ring mounted in a buoy for power transmission from a generating vessel to an offshore installation. The vessel can weathervane around the buoy in response to wind en current conditions, the slip ring transmitting high voltage three phase power. The conductors of the inner element—rotor—are annular plates mounted on a central frame of dielectric support brackets, alternately with washer-like dielectric barriers. The conductors of the outer element—stator—are provided by carbon brushes mounted in brush holders 69 and contact the conductive copper rings of the contacts of the rotor. The open ring stack allows high dielectric insulating oil to circulate through the stack, allowing smaller dimensions compared to using air as a dielectric.

The known swivel has as a disadvantage that the dielectric oil may be contaminated by the particles originating from the carbon brushes upon wear. Hereby the maximum voltage which can be transmitted by the swivel is limited.

Furthermore, use of a circulating liquid dielectric insulator in the known swivel is relatively complex and requires the need for additional pumps and liquid tight design of bearings, while at the same time posing limitations to the maximum voltage to be transmitted by the swivel.

It therefore is an object of the present invention to provide a high voltage swivel of compact and reliable design which can be operated a relatively high voltages.

Hereto the high voltage swivel according to the present invention is characterized in that the electrical contacts of the outer element are provided in a recess in an annular solid outer insulating ring, the electrical contacts of the inner element are provided in a recess in an annular solid inner insulating ring, coaxial with the outer ring, the inner and outer insulating rings each defining a boundary surface extending in an axial direction, the boundary surfaces of each rings being placed in close proximity, the electrical conductors being placed with their contact surfaces at or near the boundary surface.

By the use of solid insulating material in the form of insulating rings, a high dielectric strength can be achieved such that high voltages on the electrical contacts are possible, such as voltages up to 33 kV at for instance a nominal current of 395 A. Furthermore, the use of the solid insulating material allows the size and weight of the swivel to be reduced, and hence helps to limit bending moments on the turret swivel stack. Reduced contamination of the insulating material by particles resulting from wear of the electrical contacts occurs, such that the insulating properties are maintained during the lifetime of the swivel.

In one embodiment, the conductors at the outer and at the inner element comprise annular contact surfaces. By the use of ring-shaped contact surfaces, instead of known carbon brushes, contamination of dielectric oil in the swivel, which can be used inside for instance 11 kv can be avoided.

In the swivel, each electrical contact comprises a connector extending axially from the conductor to a connector surface, situated in an enclosure bound by a cover with a an opening for fixedly receiving a power cable and with fastening means for connecting the cover to the outer element, each connector at the connector surface being provided with a receiving cavity for receiving a conducting wire of the power cable. By integration of the power cable in terminal boxes that are integrated in the body of the swivel, certification of the complete swivel can be carried out without a lower voltage limit being imposed by the connectors, which would be the case when connectors of an Exe protected type would be applied.

A suitable material for use as the solid insulating material comprises a polymer solid electric insulator of polyether ether ketone commercially available under the tradename PEEK from Entegri's Inc.

A suitable copper alloy for the electrical contacts is commercially available under the tradename MULTILAM® copper alloy. Multilam is a nickel plated copper alloy strip that uses multiple leaf spring louvers and allows contact to be made via a large number of defined contact points. Each louver forms an independent current bridge, so that the many parallel louvers substantially reduce the overall contact resistance.

Because of the high power transmitted by the electrical swivel of the present invention, it can be used in an offshore construction comprising a first floating structure provided with a vessel anchored to the sea bed in a weathervaning manner via a turret, the vessel being provided with at least one swivel according to the invention, an electrical lead extending from a power supply on the vessel to a sub sea power cable via the swivel, the sub sea power cable.

The electrical lead can extend to one or more unmanned satellite platforms to export for instance 22.5 MVA of power, whereas the electrical generation plant is situated on an FPSO due to economy of scale benefits and presence of the operation and maintenance crews. On the platforms the main drives (e.g. gas compression, water injection, gas lift) are electrical, high reliability and low maintenance allowing the platforms to be unmanned.

Another suitable application of the high power swivel according to the present invention is to export electricity to an onshore location from an offshore FPSO. Instead of reinjection into the well or transport of gas to shore, gas turbines can be used on the FPSO to produce electricity which is transported, via the swivel according to the present invention and a submarine power cable to an onshore power grid.

Again another application of the present swivel is to supply power from an FPSO to a sub sea pipeline for heating of the pipeline to counteract hydrate formation due to low sea water temperatures.

An embodiment of a high voltage swivel according to the present invention will be described in detail, by way of non-limiting example, in the appended drawing. In the drawing.

Figure 6A:
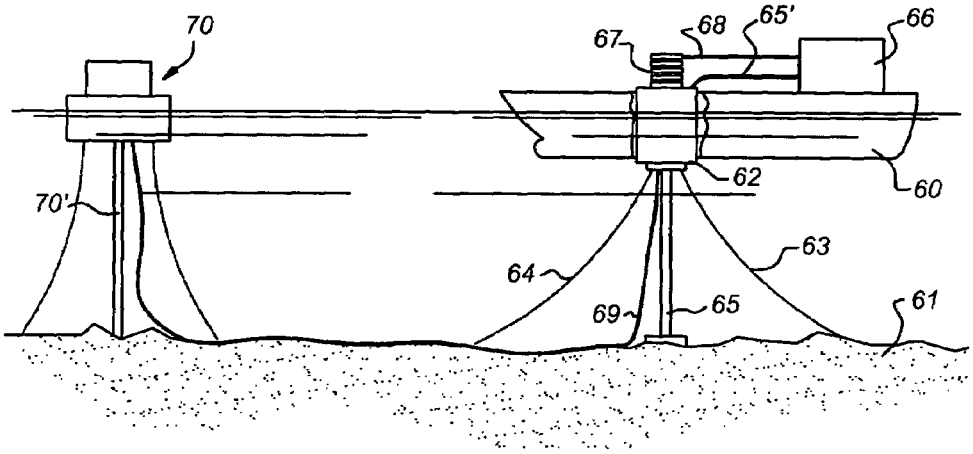
Figure 6B:
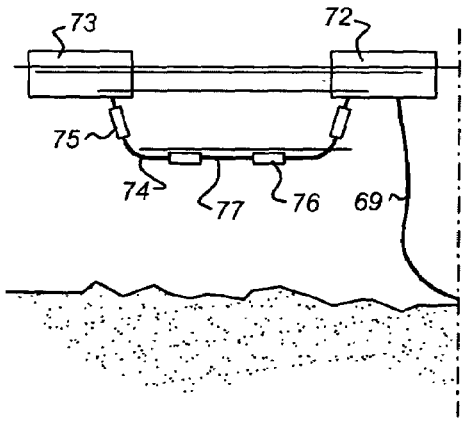
Figure 6C:
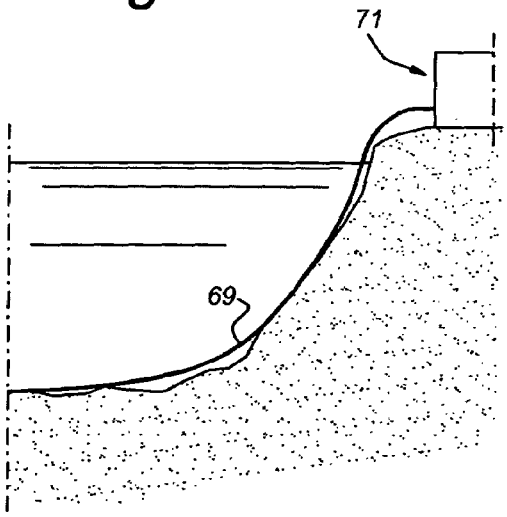

FIGS. 6*a*–6*c* show an offshore system comprising a high voltage swivel according to the present invention.

Figure 1:
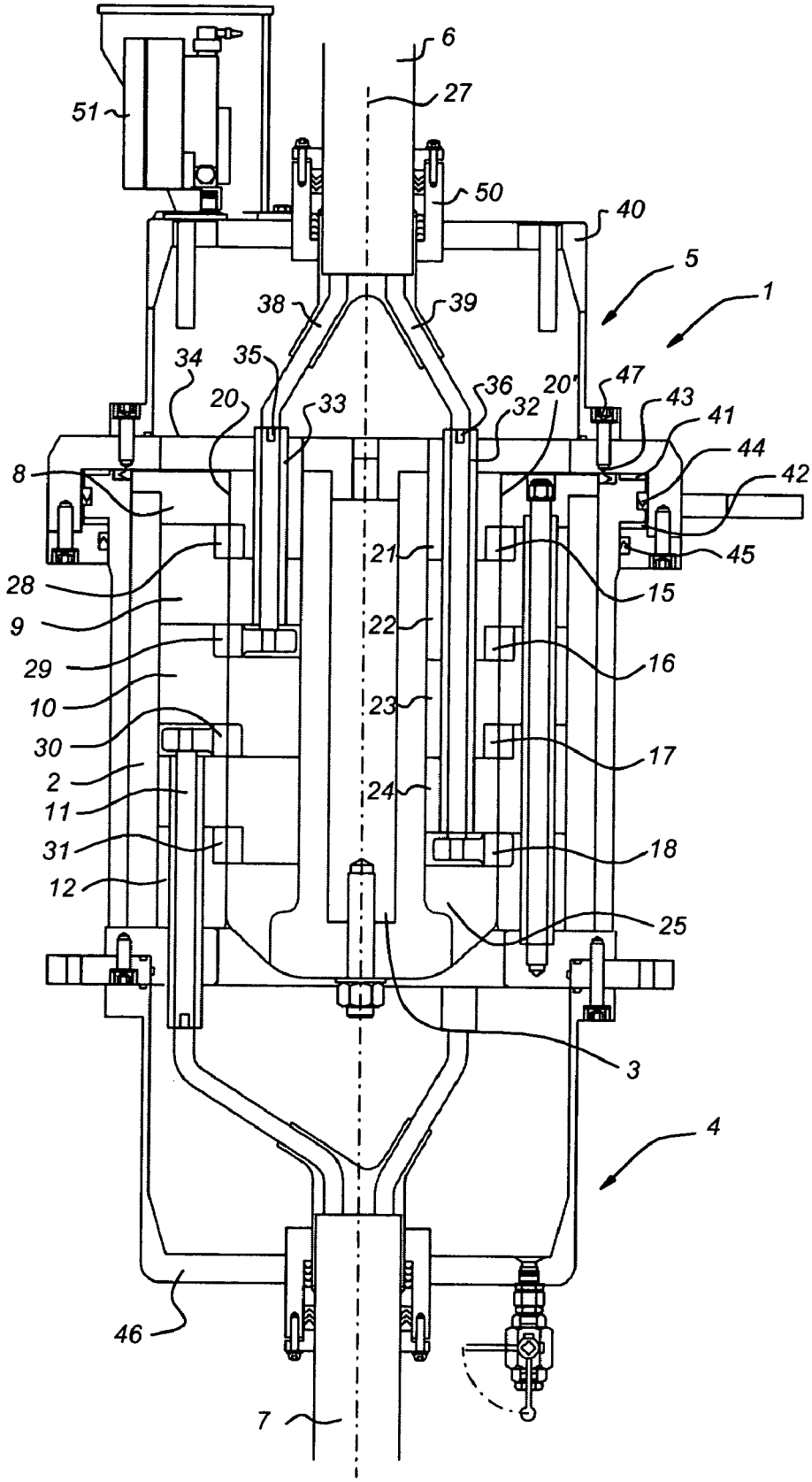
FIG. 1 shows a longitudinal cross-sectional view of a high voltage swivel according to the present invention.

FIG. 1 shows a high voltage swivel 1, comprising a stationary outer annular wall 2 and an inner cylindrical support 3. The outer annular wall 2 is connected to top and bottom connector boxes 4,5 for connection to three phase power cables 6, 7. Within the annular wall 2, five insulating rings 8,9,10,11 and 12 are provided which are fixed to the outer wall 2. In the insulating rings 8–13 a recess is provided in which an annular conductor 15,16,17,18 is situated. A boundary surface 20 of the outer insulating rings 8–11 is contacting the boundary surface of five inner annular insulators 21–24 which are fixed to the inner cylindrical support 3. The inner annular insulators 21–24 and the cylindrical element 3 are rotatable around longitudinal axis 27. Conductors 28–31 are provided in recesses of the insulating rings 21–24. The conductors 28–31 are preferably formed by ring-shaped conductors, but may be comprised of other shapes, such as cylindrical or spherical shapes. The insulators 8–12 and 21–24, even as the conductors 15–18 and 28–31 comprise contact surfaces in mutual contact at the boundary surface 20, for transmission of current from a rotatable power lead 6, to a stationary power lead 7.

The inner electrical conductors 15–18 are connected to electrical connectors 32,33 which extend axially to a connector surface 34 of the upper connector box 5. The connectors 32, 33 comprise a cavity 35,36 for receiving a cable 38,39 of three phase power lead 6. A cover 40 of the connector box is rotatably connected to the outer wall 2 via bearings 41,42 seals 43,44,45 and bolts 47. The lower connector box 4 comprises the same layout as upper connector box 5, and is with a cover 46 fixedly connected to the outer wall 2. The power leads 6,7 are clampingly attached to each cover 40,46 via a clamping device 50.

Dielectric oil is protected from overpressure, over temperature and leakage via a Buchholz Relay unit 51 comprising a compensation bladder for accommodating thermally induced expansion and contraction of the dielectric oil. The present swivel is suitable for high voltages, such as 33 kV at currents of 395 A or more.

Figure 2:
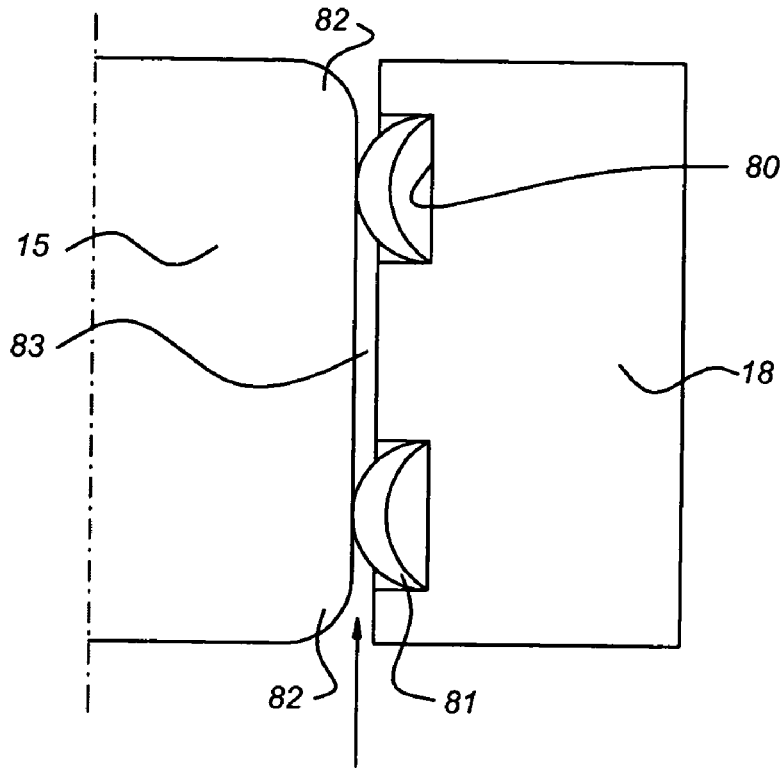
FIG. 2 is a schematic cross-sectional view through a conductor pair of FIG. 1.

The conductor 15 shown in FIG. 2 is made of bronze and has rounded corners for ease of assembly. The opposite bronze conductor 18 is provided with recesses in which a multi-contact ring, such as a Multilam® ring, is provided for a resilient conductive contact in a number of contact points, hence reducing contact friction. The gap 83 between the conductors 15, 18 is filled with dielectric oil.

Figure 3:
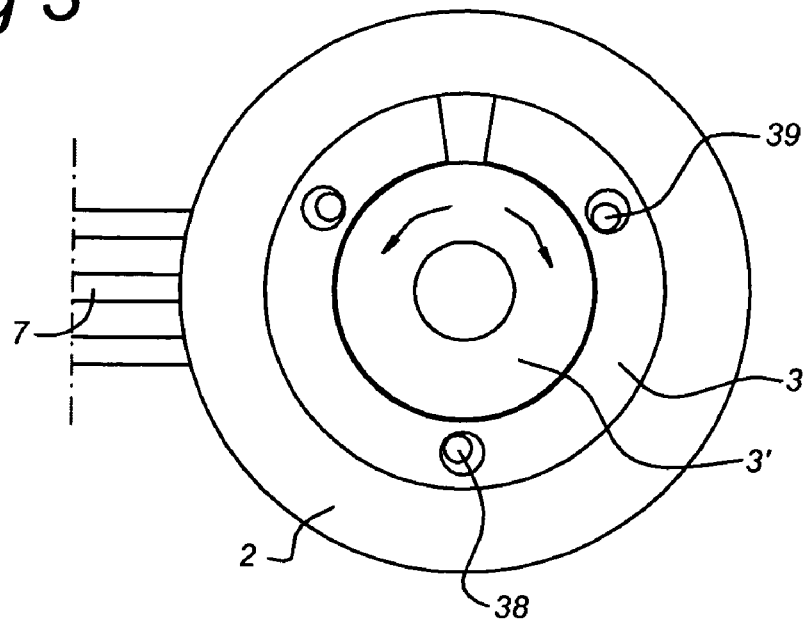
FIG. 3 shows an embodiment of a cross-sectional view through the high voltage swivel of FIG. 1.

As can be seen from FIG. 3, the inner cylindrical support 3, which may be the rotating part, the outer wall 2 being stationary, is comprised of a first split ring and an inner ring 3' of closed circumference, to which the power cables 38, 39 are connected. To avoid wear of the conductors 15–18 and 21–24 due to constant small-motion relative movements of the rings 2 and 3, the split ring of the cylindrical support 3 can slightly deform and remain stationary against outer wall 2, upon small excursions of inner ring 3'. Upon larger rotations, e.g larger than 5°, of the inner ring 3', the split ring of support 3 will follow the outer ring's movements. As can be seen from FIG. 4, the inner and outer rings 3,3' are coupled via biasing spring 14.

Figure 4:
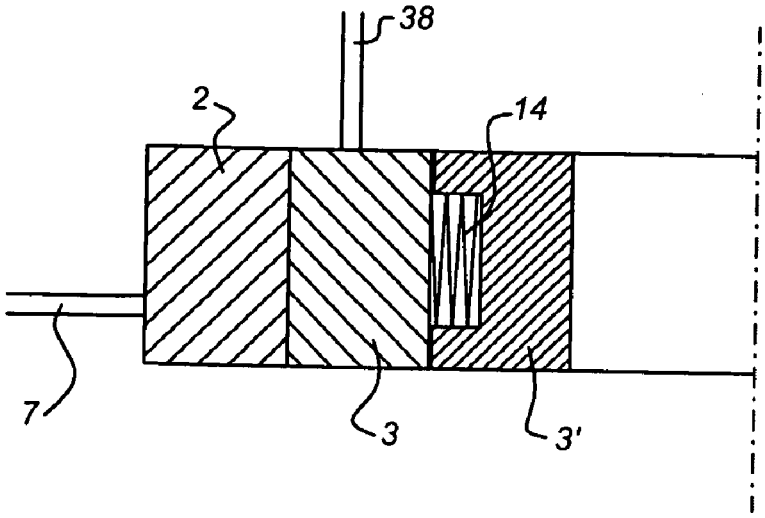
FIG. 4 shows a detail of the rings of the swivel of FIG. 3.
Figure 5:
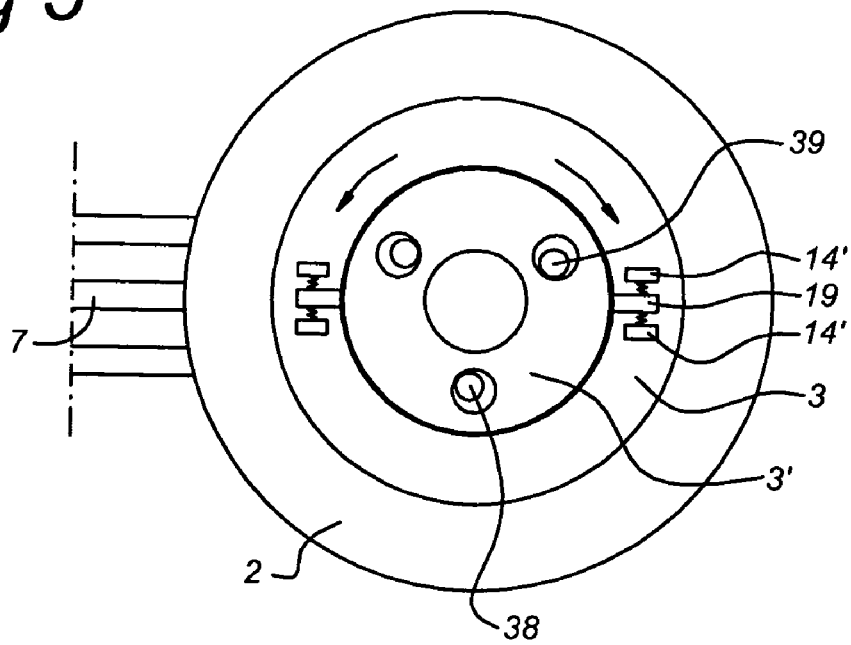
FIG. 5 shows an alternative embodiment of a swivel of FIG. 1.

In the embodiment of FIG. 4, the inner ring 3' is attached to the outer cylindrical support 3 of closed circumference via radial projection 19, which is situated between two springs 14, 14' on the cylindrical support 3. This allows small motions of the inner ring 3' with respect to the support 3, which upon such small motions can remain stationary against outer wall 2 to avoid small motion wear.

FIGS. 6*a*–6*c* show an offshore system comprising a Floating Production Storage and Offloading vessel (FPSO) 60 which is anchored to the sea bed 61 via a turret 62, at the bottom of which anchor lines 63 and 64 are attached. The vessel 60 can weathervane around the turret 62, which is geostationary. A product riser 65 extends from a sub sea hydrocarbon well to a product swivel (not shown) on the FPSO 60 and from the product swivel via duct 65' to production and/or processing equipment on the FPSO. In a power generation unit 66, gas produced from the well may be converted into electricity which is supplied to a swivel 67 according to the present invention. The power lead 68 extending from the power generation unit 66 is attached to conductors on the inner cylindrical support of the swivel 67 which is stationary relative to vessel 60. The power lead 69, extending to the sea bed is connected to the electrical conductors of the outer annular wall of the swivel 67 which is fixedly attached to the turret 62. The power lead 69 may extend to an unmanned platform 70 attached to the sea bed via product riser 70', such as a gas riser, or may extend to an on-shore power grid 71, or may be connected to heating elements 75, 76 of a substantially horizontal hydrocarbon transfer duct 77 between two floating structures 72,73.

The invention claimed is:

1. High voltage swivel (1), comprising an annular outer element (2) defining a cylindrical chamber around a longitudinal axis (27) and an inner cylindrical element (3) coaxial with the outer element (2) and rotatable relative to said outer element around said longitudinal axis (27), the inner and outer elements each comprising at least two axially spaced electrical conductors (15,16,17,18;28,29,30,31) which conductors are rotatable with the inner and outer elements (2,3), the conductors forming at least two pairs (15,28;16,29;17,30;18,31) placed with contact surfaces in mutual electrical contact, one conductor in each pair (15, 16,17,18) being provided at the inner element (3), the other (28, 29, 30, 31) at the outer element (2) and being connected to a respective voltage line (32,33)) which extends to an input terminal (6) and to an output terminal (7) respectively, the conductors (15–18,28–31) being surrounded by an insulating material, characterised in that, the electrical conductors (28–31) of the outer element (2) are provided in a recess in an annular solid outer insulating ring (8,9,10,11,12), the electrical conductors (15–18) of the inner element (3) are provided in a recess in an annular solid inner insulating ring (21,22,23,24), coaxial with the outer ring, the inner and outer insulating rings (8–12,21–24) each defining a boundary surface (20,20') extending in an axial direction, the boundary surfaces of the rings being placed in close proximity, the electrical conductors being placed with their contact surfaces at or near the boundary surface (20,20').

2. High voltage swivel (1) according to claim 1, wherein the conductors (15–18,28–31) at the outer and at the inner element (2,3) comprise annular contact surfaces.

3. High voltage swivel (1) according to claim 1, each electrical conductor being attached to a connector (32,33) extending axially from the conductor to a connector surface (34), situated in an enclosure bound by a cover (40) with a an opening 50) for fixedly receiving a power cable (6) and with fastening means (47) for connecting the cover (40) to the outer element (2), each connector (32,33) at the connector surface (34) being provided with a receiving cavity (35,36) for receiving a conducting wire (38,39) of the power cable (6).

4. High voltage swivel (1) according to claim 1, the insulating ring (8–12;21–24) comprising a solid insulator of a thermoplastic polymer, such as PEEK, PES, PTFE or Teflon®.

5. High voltage swivel according to claim 4, the insulating ring comprising a polyether ether ketone (PEEK) polymer.

6. High voltage swivel (1) according to claim 1, wherein the electrical conductors comprise a copper alloy, such as a MULTILAM® conductor.

7. Offshore construction comprising a first floating structure (60 anchored to the sea bed in a weathervaning manner via a turret (62), the structure (60) being provided with 30 at least one swivel (67) according to claim 1, an electrical lead (68) extending from a power supply (66) on the vessel to a sub sea power cable (69) via the swivel.

8. Offshore construction according to claim 7, the power cable (69) extending to at least a second floating structure (70), at a distance from the first structure, the second structure connected to a sub sea hydrocarbon well via a riser (70').

9. Offshore construction according to claim 8, the first floating structure (60) being connected to a sub sea gas field via a riser (65), the power cable (69) extending to an on shore power grid (71), the power supply (66) at the first floating structure (60) comprising a gas turbine.

10. Offshore construction according to claim 7, the power cable (69) being connected to a sub sea hydrocarbon transport duct (74) provided with heating elements (75,76) for temperature control of the transported hydrocarbon.

11. High voltage swivel (1) according to claim 2, the insulating ring (8–12;21–24) comprising a solid insulator of a thermoplastic polymer, such as PEEK, PES, PTFE or Teflon®.

12. High voltage swivel (1) according to claim 3, the insulating ring (8–12;21–24) comprising a solid insulator of a thermoplastic polymer, such as PEEK, PES, PTFE or Teflon®.

13. High voltage swivel (1), comprising an annular outer element (2) defining a cylindrical chamber around a longitudinal axis (27) and an inner cylindrical element (3)

coaxial with the outer element (2) and rotatable relative to said outer element around said longitudinal axis (27), the inner and outer elements each comprising at least two axially spaced electrical conductors (15,16,17,18;28,29,30, 31) which conductors are rotatable with the inner and outer elements (2,3), the conductors forming at least two pairs (15,28;16,29;17,30;18,31) placed with contact surfaces in mutual electrical contact, one conductor in each pair (15, 16,17,18) being provided at the inner element (3), the other (28, 29, 30, 31) at the outer element (2) and being connected to a respective voltage line (32,33)) which extends to an input terminal (6) and to an output terminal (7) respectively, the conductors (15–18,28–31) being surrounded by an insulating material, characterised in that, each conductor (15–18; 28–31) comprises an annular metal contact surface.

14. High voltage swivel (1) according to claim 13, the metal comprising a copper alloy, such as a MULTILAM® conductor.

* * * * *